US007299717B2

(12) United States Patent
Chen

(10) Patent No.: US 7,299,717 B2
(45) Date of Patent: Nov. 27, 2007

(54) HAMMERING TOOL WITH ADJUSTABLE NAIL-DRAWING DEVICE

(75) Inventor: Ying-Chien Chen, Taichung Hsien (TW)

(73) Assignee: Lucky-Brand Industrial Co., Ltd. (TW)

( * ) Notice: Subject to any disclaimer, the term of this patent is extended or adjusted under 35 U.S.C. 154(b) by 0 days.

(21) Appl. No.: 11/409,312

(22) Filed: Apr. 24, 2006

(65) Prior Publication Data

US 2007/0209483 A1 Sep. 13, 2007

(30) Foreign Application Priority Data

Mar. 7, 2006 (TW) ..... 95203781 U

(51) Int. Cl.
*B25D 1/00* (2006.01)
*B25C 11/00* (2006.01)

(52) U.S. Cl. ..... 81/20; 254/26 E

(58) Field of Classification Search ..... 254/26 R, 254/26 E, 27, 25; 81/20
See application file for complete search history.

(56) References Cited

U.S. PATENT DOCUMENTS

| | | | | |
|---|---|---|---|---|
| 524,539 | A * | 8/1894 | Burgess et al. | 254/26 E |
| 1,067,729 | A * | 7/1913 | Frey | 254/26 E |
| 1,125,999 | A * | 1/1915 | Frey | 254/26 E |
| 2,643,854 | A * | 6/1953 | Johnson | 254/26 E |
| 4,422,620 | A | 12/1983 | Nitzberg | |
| 6,279,876 | B1 * | 8/2001 | Massie | 254/26 E |
| 2005/0017225 | A1 | 1/2005 | Sleiman | |

* cited by examiner

*Primary Examiner*—D. S. Meislin
(74) *Attorney, Agent, or Firm*—Browdy and Neimark, PLLC

(57) ABSTRACT

A hammering tool includes a hammer, a frame and a fastener. The hammer has a shaft and a hammer head, and the hammer head has a claw. The hammer head has two slots and two bores. The frame has a fulcrum portion and two arms, wherein the arms are received in the slots. The frame is moved along the slots between a first position, in which the fulcrum portion is proximal to the hammer head, and a second position, in which fulcrum portion is distal to the hammer head. The fastener has two pins to be inserted into the bores when the frame is moved to the first position or at the second position.

20 Claims, 3 Drawing Sheets

HAMMERING TOOL WITH ADJUSTABLE NAIL-DRAWING DEVICE

BACKGROUND OF THE INVENTION

1. Field of the Invention

The present invention relates generally to a hammering tool, and more particular to a hammering tool with an adjustable nail-drawing device.

2. Description of the Related Art

Conventional claw hammers include a shaft and a metal hammer head. User may hold the shaft to hammer objects by the hammer head. The hammer head includes a column-like hammer portion and a claw portion at a rear thereof. The claw portion has a V-shaped claw to draw nails. To draw a nail out of an object, such as wood plate, user has to engage the claw with the nail. In such condition, the claw hammer works like a lever, the claw is resistance, the top of the hammer head, which touches the object, is fulcrum and the shaft is effort, so that user may exerts the shaft to lever the nail out.

Typically, the claw has a limited slope relative to the top of the hammer head, such that the nails only may be drawn out for a predetermined distance. In other words, only shorter nails may be totally drawn out of the object by the claw hammer. For the longer nails, the claw hammer only draw half of it out of the object, and user has to take other tool, such as pliers, to draw the nail out.

Many inventions, such as U.S. Pat. No. 4,422,620 and U.S. Publication No. 2005/0017225, are presented to overcome above drawback. The first invention provides a hammer with a bolt screwed in the top of the hammer head. The bolt is screwed to adjust the height of the bolt, such that the hammer may draw the nail for longer distance when the bolt is screwed with greater height. The second invention's hammer is provided with a bolt embedded in the hammer head. The bolt is moved between two positions, in one of which the bolt is protruded out the hammer head, and in another of which the bolt is received in the hammer head. Both of inventions provide the bolt screwed in a threaded hole of the hammer head. The threads of the bolt or the thread hole may be broken when the hammer is levering the nail by the claw. When the threads are broken, the bolt may be jammed in the thread hole or may be loosed that the hammer loses the adjustable nail-drawing function.

SUMMARY OF THE INVENTION

The primary objective of the present invention is to provide a hammering tool with an adjustable nail-drawing device, which the nail-drawing device is easier to be adjusted.

The secondary objective of the present invention is to provide a hammering tool, which the nail-drawing device is firm enough to take the force when the hammering tool draws a nail out.

According to the objective of the present invention, a hammering tool includes a hammer, a frame and a fastener. The hammer has a shaft and a hammer head, and the hammer head has a claw to draw a nail out. The frame has a fulcrum portion to be movable connected to the hammer head. The frame is moved between a first position, in which the fulcrum portion is proximal to the hammer head, and a second position, in which fulcrum portion is distal to the hammer head. The fastener fixes the frame at the first position or at the second position.

DETAILED DESCRIPTION OF THE INVENTION

Figure 1:
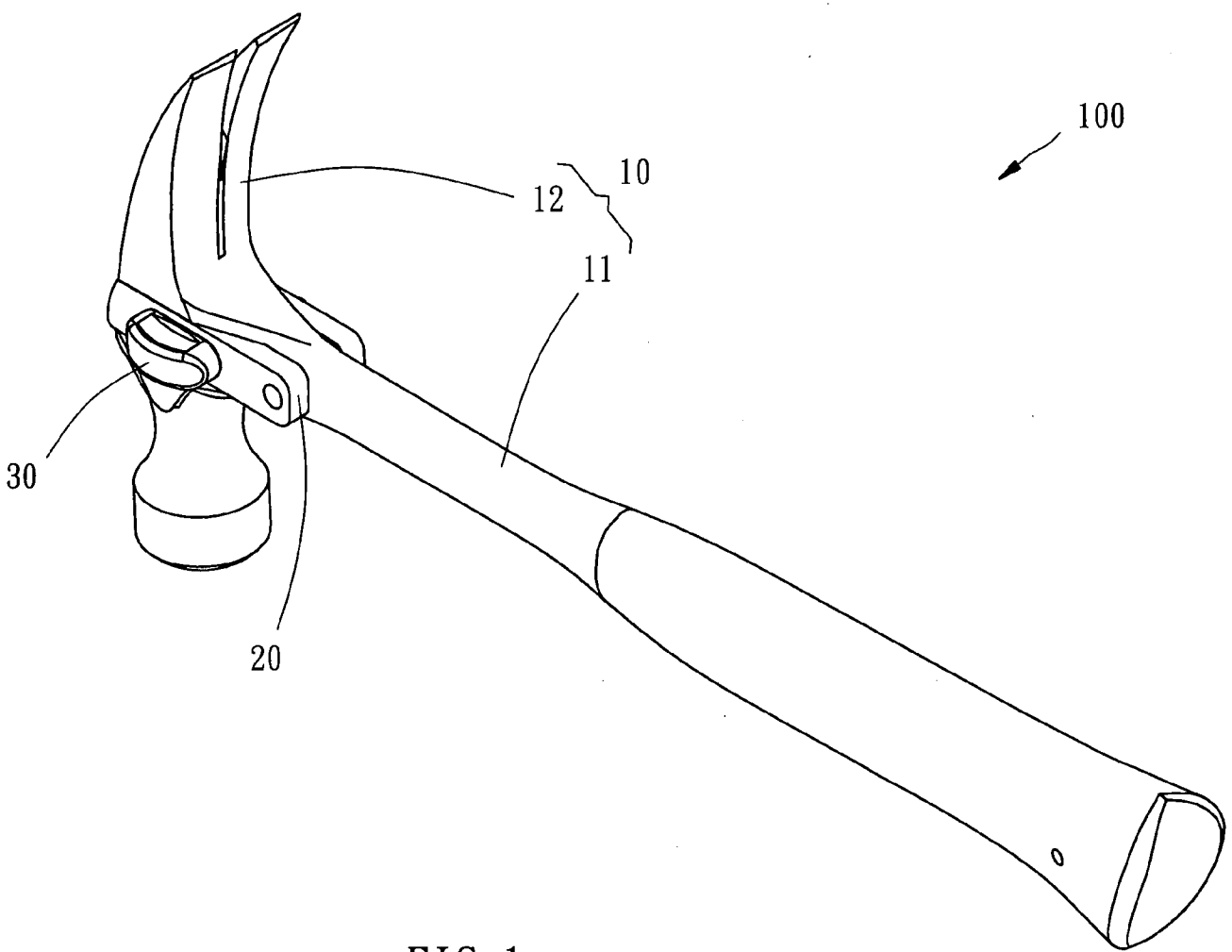
FIG. 1 is a perspective view of a preferred embodiment of the present invention.
Figure 2:
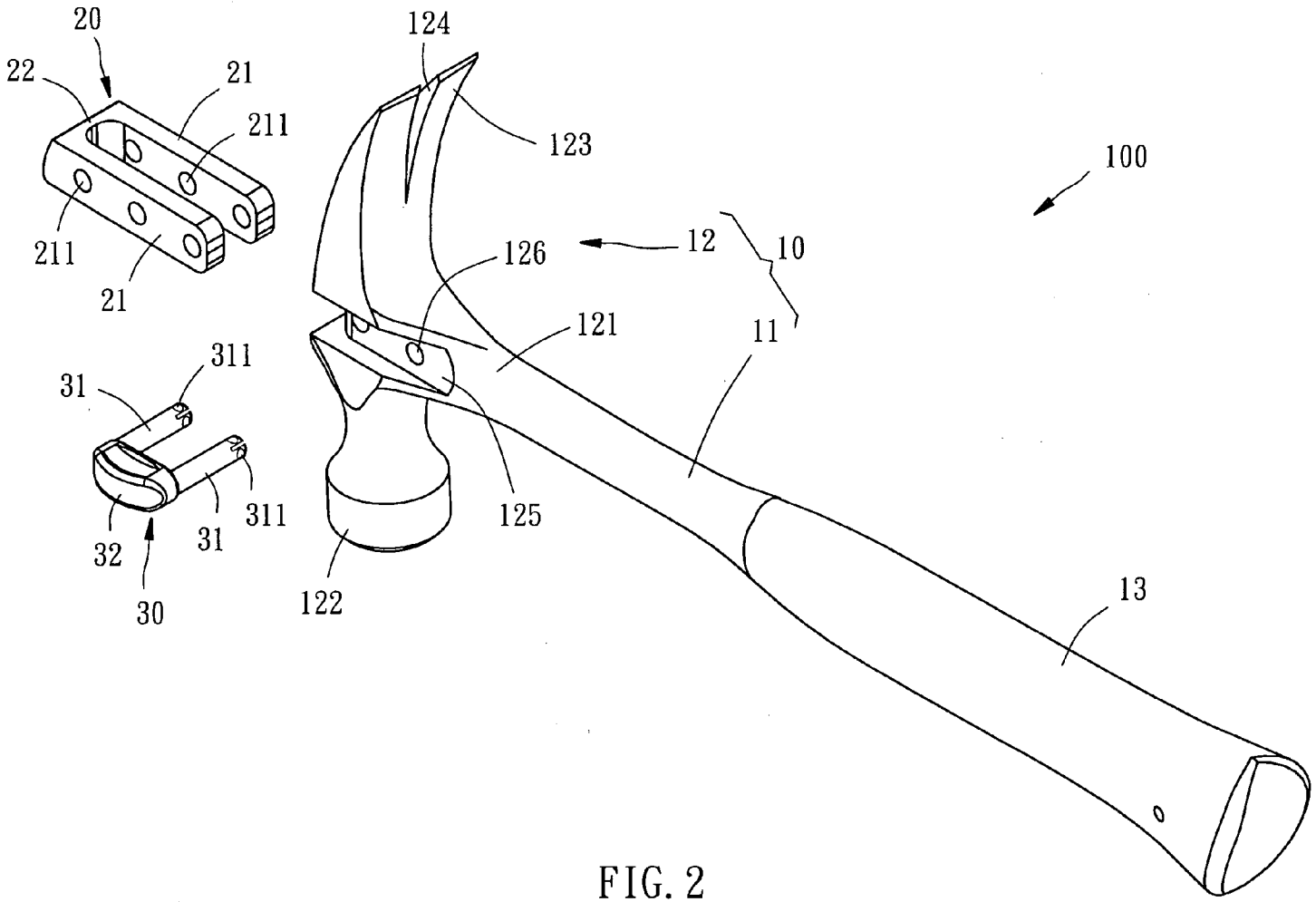
FIG. 2 is an exploded view of the preferred embodiment of the present invention.

As shown in FIG. 1 and FIG. 2, a hammering tool 100 of the preferred embodiment of the present invention includes a hammer 10, a frame 20 and a fastener 30.

The hammer 10 includes a single metal unit having a shaft 11 and a hammer head 12. A soft handle 13 is fitted to an end of the shaft 11 for gripping. The hammer head 12 includes a body portion 121 connected to an end of the shaft 11, a head 122 at a front end of the body portion 121 and a V-shaped claw 123 at a rear end of the body portion 121. The head 122 is a column-like member for hammering. The claw 123 is a taper member with a tip end for crack something, which has a gap 124 at the tip end to draw the nail. The body portion 121 is provided with two slots 125 at opposite thereof, which are parallel to the shaft 11, and two bores 126 with opposite ends on bottoms of the slots 125 respectively.

Figure 4:
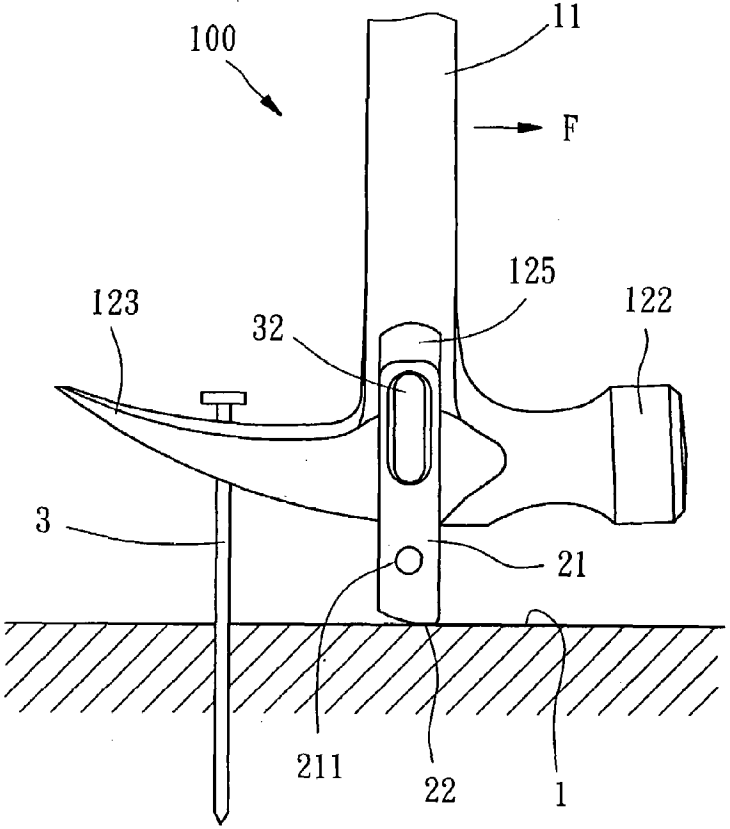
FIG. 4 is a sketch diagram of the preferred embodiment of the present invention, showing the hammering tool drawing a shorter nail.

The frame 20 has two parallel arms 21 and a fulcrum portion 22 with opposite ends connected to ends of the arms 21. Each of the arms 21 has three bores 211, and an interval between the neighboring bores 21 is identical to that between the bores 126. The arms 21 are received in the slots 125 of the hammer 10 to be moved between a first position (FIG. 3) and a second position (FIG. 4). When the frame 20 is moved to the first position, the bore 211 proximal to the fulcrum portion 22 and the middle bore 211 are aligned with the bores 126 respectively, and when the frame 20 is moved to the second position, the middle bore 211 and the bore 211 distal to the fulcrum portion 22 are aligned with the bores 126 respectively.

A fastener 30 has a base 32 and two pins 31 on the base 32. An interval between the pins 31 is identical to that between the bores 211 and 126. Each of the pins 31 has an elastic portion 311 at a distal end thereof, which has a diameter greater than that of the bores 211 and may be compressed to narrow the diameter thereof. The pins 31 of the fastener 30 may be inserted into the bores 211 and 126 of the frame 20 and the hammer 10 to fix the frame 20 on the hammer 10 when the frame 20 is moved to the first position (FIG. 3) or the second position (FIG. 4). When the pins 31 of the fastener 30 are inserted into the bores 211 and 126, the elastic portions 311 are extruded out of the bores 211 of the frame 20 to prevent the fastener 30 from escaping.

Figure 3:
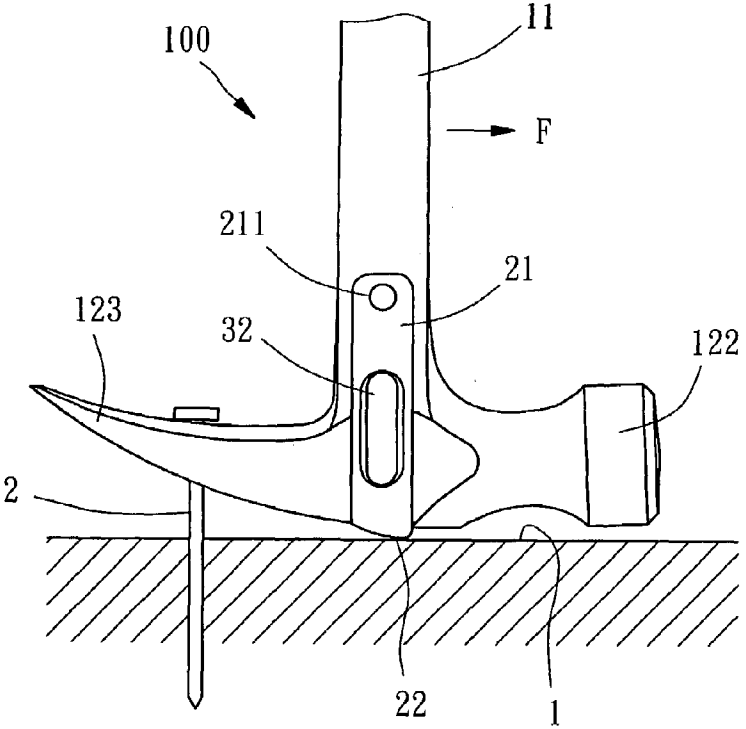
FIG. 3 is a sketch diagram of the preferred embodiment of the present invention, showing the hammering tool drawing a longer nail.

When user wants to lever a short 2 out of an object 1 by the hammering tool 100 of the present invention, user has to move the frame 20 to the first position and insert the pins 31 of the fastener 30 into the bores 211 and 126 of the frame 20 and the hammer 10. In this condition, the fulcrum portion 22 of the frame 20 is proximal to the hammer head 12 to be a short fulcrum, as shown in FIG. 3. After adjustment of the frame 20, user may engage the nail with the claw 123 and rest the fulcrum portion 22 of the frame on the object 2. After that, user may exert the shaft 11 along the arrow F to lever the nail 2 out.

On the contrary, if user wants to draw a long nail 3, as shown in FIG. 4, user has to pull the fastener 30 out and move the frame 20 to the second position, and then insert the pins 31 of the fastener 30 into the bores 211 and 126 again. In this condition, the fulcrum portion 22 of the frame 20 is kept a distance from the hammer head 12 to be a long fulcrum, such that user may lever the nail 3 out.

The present invention provides the movable frame 20 on the hammer head 12 to adjust the height of the fulcrum of the levering system of the hammering tool of the present invention.

What is claimed is:

1. A hammering tool, comprising:

a hammer having a shaft and a hammer head, wherein the hammer head has a claw to draw a nail out;

a frame, which has a fulcrum portion, movable connected to the hammer head to be moved between a first position, in which the fulcrum portion is proximal to the hammer head, and a second position, in which fulcrum portion is distal to the hammer head;

a fastener fixing the frame at the first position or at the second position;

wherein the hammer head has a bore, and the frame has two bores on the arm, and the fastener has a pin, whereby the bore of the frame proximal to the fulcrum portion is aligned with the bore of the hammer head when the frame is moved to the first position to insert the pin of the fastener into the bores, and the bore of the frame distal to the fulcrum portion is aligned with the bore of the hammer head when the frame is moved to the second position to insert the pin of the fastener into the bores; and wherein the pin of the fastener has an elastic portion at a distal end thereof, which is extruded out of the bore of the frame when the pin is inserted into the bores.

2. The hammering tool as defined in claim 1, wherein the hammer head has a slot, and the frame has an arm received in the slot and sliding along the slot.

3. The hammering tool as defined in claim 1, wherein the hammer head has two slots on opposite sides, and the frame has two arms received in the slots and sliding along the slots.

4. The hammering tool as defined in claim 3, wherein the hammer head has two bores with ends open at bottoms of the slots, and the frame has three bores on the arm, and the fastener has two pins, whereby the bores of the frame proximal to the fulcrum portion are aligned with the bores of the hammer head when the frame is moved to the first position to insert the pins of the fastener into the bores, and the bores of the frame distal to the fulcrum portion are aligned with the bores of the hammer head when the frame is moved to the second position to insert the pins of the fastener into the bores.

5. The hammering tool as defined in claim 4, wherein each of the pins of the fastener has an elastic portion at a distal end thereof, which is extruded out of the bore of the frame when the pin is inserted into the bores.

6. The hammering tool as defined in claim 1, wherein the hammer head has two bores, and the frame has a bore on the arm, and the fastener has a pin, whereby the bore of the hammer head proximal to the shaft is aligned with the bore of the frame when the frame is moved to the first position to insert the pin of the fastener into the bores, and the bore of the hammer head distal to the shaft is aligned with the bore of the frame when the frame is moved to the second position to insert the pin of the fastener into the bores.

7. The hammering tool as defined in claim 6, wherein the pin of the fastener has an elastic portion at a distal end thereof, which is extruded out of the bore of the frame when the pin is inserted into the bores.

8. A hammering tool, comprising:

a hammer having a shaft and a hammer head, wherein the hammer head has a claw to draw a nail out;

a frame, which has a fulcrum portion, movable connected to the hammer head to be moved between a first position, in which the fulcrum portion is proximal to the hammer head, and a second position, in which fulcrum portion is distal to the hammer head;

a fastener fixing the frame at the first position or at the second position; and wherein the hammer head has two bores, and the frame has a bore on the arm, and the fastener has a pin, whereby the bore of the hammer head proximal to the shaft is aligned with the bore of the frame when the frame is moved to the first position to insert the pin of the fastener into the bores, and the bore of the hammer head distal to the shaft is aligned with the bore of the frame when the frame is moved to the second position to insert the pin of the fastener into the bores.

9. The hammering tool as defined in claim 8, wherein the hammer head has a bore, and the frame has two bores on the arm, and the fastener has a pin, whereby the bore of the frame proximal to the fulcrum portion is aligned with the bore of the hammer head when the frame is moved to the first position to insert the pin of the fastener into the bores, and the bore of the frame distal to the fulcrum portion is aligned with the bore of the hammer head when the frame is moved to the second position to insert the pin of the fastener into the bores.

10. The hammering tool as defined in claim 9, wherein the pin of the fastener has an elastic portion at a distal end thereof, which is extruded out of the bore of the frame when the pin is inserted into the bores.

11. The hammering tool as defined in claim 8, wherein the hammer head has a slot, and the frame has an arm received in the slot and sliding along the slot.

12. The hammering tool as defined in claim 8, wherein the hammer head has two slots on opposite sides, and the frame has two arms received in the slots and sliding along the slots.

13. The hammering tool as defined in claim 12, wherein the hammer head has two bores with ends open at bottoms of the slots, and the frame has three bores on the arm, and the fastener has two pins, whereby the bores of the frame proximal to the fulcrum portion are aligned with the bores of the hammer head when the frame is moved to the first position to insert the pins of the fastener into the bores, and the bores of the frame distal to the fulcrum portion are aligned with the bores of the hammer head when the frame is moved to the second position to insert the pins of the fastener into the bores.

14. The hammering tool as defined in claim 13, wherein each of the pins of the fastener has an elastic portion at a distal end thereof, which is extruded out of the bore of the frame when the pin is inserted into the bores.

15. The hammering tool as defined in claim 8, wherein the hammer head has two bores, and the frame has a bore on the arm, and the fastener has a pin, whereby the bore of the hammer head proximal to the shaft is aligned with the bore of the frame when the frame is moved to the first position to insert the pin of the fastener into the bores, and the bore of the hammer head distal to the shaft is aligned with the bore of the frame when the frame is moved to the second position to insert the pin of the fastener into the bores.

16. The hammering tool as defined in claim 15, wherein the pin of the fastener has an elastic portion at a distal end thereof, which is extruded out of the bore of the frame when the pin is inserted into the bores.

17. A hammering tool, comprising:

a hammer having a shaft and a hammer head, wherein the hammer head has a claw to draw a nail out;

a frame, which has a fulcrum portion, movable connected to the hammer head to be moved between a first position, in which the fulcrum portion is proximal to the hammer head, and a second position, in which fulcrum portion is distal to the hammer head;

a fastener fixing the frame at the first position or at the second position;

wherein the hammer head has two slots on opposite sides, and the frame has two arms received in the slots and sliding along the slots; and wherein the hammer head has two bores with ends open at bottoms of the slots, and the frame has three bores on the arm, and the fastener has two pins, whereby the bores of the frame proximal to the fulcrum portion are aligned with the bores of the hammer head when the frame is moved to the first position to insert the pins of the fastener into the bores, and the bores of the frame distal to the fulcrum portion are aligned with the bores of the hammer head when the frame is moved to the second position to insert the pins of the fastener into the bores.

18. The hammering tool as defined in claim 17, wherein the hammer head has a slot, and the frame has an arm received in the slot and sliding along the slot.

19. The hammering tool as defined in claim 17, wherein the hammer head has two slots on opposite sides, and the frame has two arms received in the slots and sliding along the slots.

20. The hammering tool as defined in claim 17, wherein the hammer head has a bore, and the frame has two bores on the arm, and the fastener has a pin, whereby the bore of the frame proximal to the fulcrum portion is aligned with the bore of the hammer head when the frame is moved to the first position to insert the pin of the fastener into the bores, and the bore of the frame distal to the fulcrum portion is aligned with the bore of the hammer head when the frame is moved to the second position to insert the pin of the fastener into the bores.

* * * * *